US008593079B2

(12) United States Patent
Sadwick et al.

(10) Patent No.: US 8,593,079 B2
(45) Date of Patent: Nov. 26, 2013

(54) LED DIMMING DRIVER

(75) Inventors: Laurence P. Sadwick, Salt Lake City, UT (US); William B. Sackett, Sandy, UT (US)

(73) Assignee: InnoSys, Inc, Salt Lake City, UT (US)

( * ) Notice: Subject to any disclaimer, the term of this patent is extended or adjusted under 35 U.S.C. 154(b) by 232 days.

(21) Appl. No.: 13/072,733

(22) Filed: Mar. 27, 2011

(65) Prior Publication Data

US 2011/0260619 A1 Oct. 27, 2011

Related U.S. Application Data

(60) Provisional application No. 61/318,767, filed on Mar. 29, 2010.

(51) Int. Cl.
*H05B 37/02* (2006.01)

(52) U.S. Cl.
USPC ..... 315/307; 315/224; 315/247

(58) Field of Classification Search
USPC ..... 315/209 R, 224, 225, 247, 291, 307, 308
See application file for complete search history.

(56) References Cited

U.S. PATENT DOCUMENTS

| | | | | |
|---|---|---|---|---|
| 6,392,368 | B1 * | 5/2002 | Deller et al. | 315/317 |
| 7,042,170 | B2 * | 5/2006 | Vakil et al. | 315/291 |
| 8,022,634 | B2 * | 9/2011 | Greenfeld | 315/192 |
| 8,203,445 | B2 * | 6/2012 | Recker et al. | 340/531 |
| 8,212,491 | B2 * | 7/2012 | Kost et al. | 315/247 |
| 2010/0060204 | A1 * | 3/2010 | Ohtake et al. | 315/307 |
| 2011/0285301 | A1 * | 11/2011 | Kuang et al. | 315/200 R |
| 2012/0176057 | A1 * | 7/2012 | Koutensky et al. | 315/210 |
| 2012/0242238 | A1 * | 9/2012 | Chen et al. | 315/200 R |

* cited by examiner

*Primary Examiner* — Don Le
(74) *Attorney, Agent, or Firm* — Hamilton, DeSanctis & Cha LLP

(57) ABSTRACT

Various embodiments of an LED dimming driver are disclosed herein. In some embodiments, an apparatus for dimmably driving at least one load includes a power supply having a voltage output, a controller having at least one current setpoint output, and at least one driver channel circuit connected to the voltage output of the power supply and to at least one of the at least one current setpoint outputs, the at least one driver channel circuit having a load output.

20 Claims, 11 Drawing Sheets

LED DIMMING DRIVER

BACKGROUND

Electricity is typically generated and distributed in alternating current (AC) form, wherein the voltage varies sinusoidally between a positive and a negative value. However, many electrical devices require a direct current (DC) supply of electricity having a constant voltage level or a constant current level, or at least a supply that remains positive even if the level is allowed to vary to some extent. For example, light emitting diodes (LEDs) and similar devices such as organic light emitting diodes (OLEDs) are being increasingly considered for use as light sources in residential, commercial and municipal applications. However, in general, unlike incandescent light sources, LEDs and OLEDs cannot be powered directly from an AC power supply unless, for example, the LEDs are configured in some back to back formation. Electrical current flows through an individual LED easily in only one direction, and if a negative voltage which exceeds the reverse breakdown voltage of the LED is applied, the LED can be damaged or destroyed. Furthermore, the standard, nominal residential voltage level is typically something like 100 VAC to 120 VAC or 200 VAC to 240 VAC, both of which are higher than may be desired for a high efficiency LED light. Some conversion of the available power may therefore be necessary or highly desired with loads such as an LED light.

In one type of commonly used power supply for loads such as an LED, an incoming AC voltage is connected to the load only during certain portions of the sinusoidal waveform. For example, a fraction of each half cycle of the waveform may be used by connecting the incoming AC voltage to the load each time the incoming voltage rises to a predetermined level or reaches a predetermined phase and by disconnecting the incoming AC voltage from the load each time the incoming voltage again falls to zero. In this manner, the voltage, current and/or power to the load may be controlled. This type of conversion scheme is often controlled so that a constant current is provided to the load even if the incoming AC voltage varies. However, if this type of power supply with current control is used in an LED light fixture or lamp, a conventional dimmer is often ineffective. For many LED power supplies, the power supply will attempt to maintain the constant current through or constant voltage across the LED despite a drop in the incoming voltage by increasing the on-time during each cycle of the incoming AC wave. Furthermore, conventional dimmers can have drawbacks such as unpredictable triggering and multiple triggering/firing events within the same cycle of the AC sinusoidal voltage at low power settings and with non-resistive loads.

SUMMARY

An LED dimming driver is disclosed that can be used to power one or more loads such as LED lighting or other types of lamps or loads. The LED dimming driver can be controlled by a number of wired or wireless interfaces. The LED dimming driver may be implemented in a modular fashion, allowing modules to be interchanged to customize the behavior or "personality" of the system.

In some embodiments, an apparatus for dimmably driving at least one load includes a power supply having a voltage output, a controller having at least one current setpoint output, and at least one driver channel circuit connected to the voltage output of the power supply and to at least one of the current setpoint outputs, the at least one driver channel circuit having a load output. In various embodiments the controller may comprise a wireless interface, a power line interface or both to receive dimming control commands. The controller is adapted to set the at least one current setpoint output at a level proportional to an externally selected dimming level, and the controller may comprise a swappable module to customize the behavior of the system.

Some embodiments include multiple driver channel circuits controlled by multiple current setpoint outputs from the controller, which is adapted to independently control each of the plurality of driver channel circuits. For example, in some embodiments the channels independently drive a white channel, a red channel, a green channel and a blue channel.

In some embodiments, the driver channel circuit includes a high side circuit and a low side circuit, the power supply provides multiple voltage outputs, and the high side circuit and the low side circuit are powered by different voltage outputs. Current flow through the primary side circuit is controlled by a switch, regulated by the output of, for example an op/amp and/or a comparator in the secondary side circuit based on the difference between the load current and the current setpoint output. The switch may be driven by a pulse width modulation circuit. An isolation device may be connected, for example, between the op/amp and/or comparator and the pulse width modulation circuit.

Other embodiments provide a method for dimmably driving a load, including generating a high voltage and a low voltage in a power supply from a power input, receiving dimming commands and generating at least one current setpoint signal in a controller circuit, and driving a load output in at least one driver channel circuit based at least on the first voltage, the second voltage and the at least one current setpoint signal.

This summary provides only a general outline of some particular embodiments. Many other objects, features, advantages and other embodiments will become more fully apparent from the following detailed description, the appended claims and the accompanying drawings.

BRIEF DESCRIPTION OF THE DRAWINGS

A further understanding of the various embodiments may be realized by reference to the figures which are described in remaining portions of the specification. In the figures, like reference numerals may be used throughout several drawings to refer to similar components. The figures are intended to provide some representative embodiments of the present invention and, as such, do not attempt to include all possible embodiments of the present invention; therefore the figures should not be viewed as limiting, in any way or form, for or of the present invention.

DESCRIPTION

Figure 1:
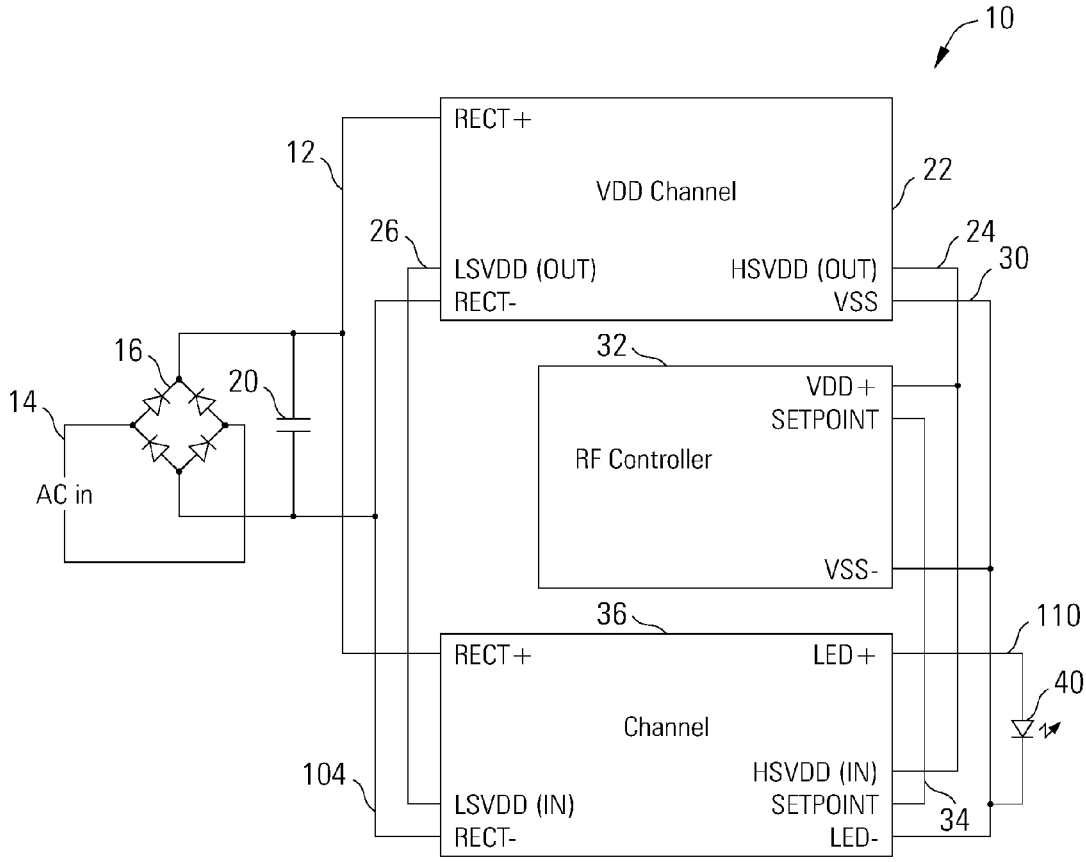
FIG. 1 depicts an example of a single channel LED dimming driver with an RF controller in accordance with some embodiments of the present invention.

The drawings and description, in general, disclose various embodiments of an LED dimming driver 10 used to power and control one or more LEDs or other loads. A DC or rectified AC signal 12 is provided to power the LED dimming driver 10, and may be based on an AC signal 14 that is rectified by a diode bridge 16 and an optional capacitor 20. The LED dimming driver 10 may include a high side portion and a low side portion as described in U.S. patent application Ser. No. 12/422,258 for a "Dimmable Power Supply", filed Apr. 11, 2009, which is incorporated herein by reference for all purposes. (See, for example, FIG. 9 of the "Dimmable Power Supply".) For example, circuitry to detect load current, and to generate a dimming control signal may be performed in the high side or secondary portion, and a pulse-width modulated switch controlling the power to the load may be performed in the low side or primary portion under the control of the dimming control signal, with the high side and low side portion either connected or isolated by a transformer or other device as desired. Note that this division of high side and low side circuitry is merely an example, and the LED dimming driver 10 is not limited to this particular configuration. Nothing in this example embodiment should be viewed as limiting in any way or form for the present invention.

In this embodiment, the power supply 22 (VDD Channel) generates two voltage outputs which in some embodiments are isolated voltage outputs, a high side voltage output HSVDD 24 and a low side voltage output LSVDD 26. In some embodiments, the power supply 22 may also provide a common ground VSS 30. The power supply 22 may include any suitable circuit or device for providing multiple output voltage levels from an input voltage source. For example, the power supply 22 may include a transformer with multiple secondary taps, producing voltage levels (HSVDD 24) and (LSVDD 26). In some embodiments, HSVDD 24 and LSVDD 26 are isolated from each other. In some embodiments, HSVDD 24 is at a higher voltage than LSVDD 26. However these previous embodiments in the last two sentences are merely examples of the present invention and should not be viewed as limiting in any way or form for the present invention.

An RF controller 32 is used to dim the lamp or otherwise control the voltage and/or current to a load. In one embodiment, the RF controller 32 dims a lamp by varying a current setpoint signal 34 which is used as a reference to control the current through the load. The RF controller 32 may receive control signals from an external source to dim the lamp, for example from any type of control device with an RF transmitter, operated by a user. Note that the RF controller in this example embodiment could also be an infrared controller, a wired controller, a controller that also used the AC power lines, etc. for communication, monitoring, control, etc. When the load current exceeds the setpoint, it is reduced to about the level set by the setpoint, for example, by reducing the pulse width and/or the on time or increasing the off time controlling the switch in the low side portion of the LED dimming driver 10. When the load current falls below the setpoint, it is increased to about the level of the setpoint, for example, by increasing the pulse width and/or the on time or decreasing the off time controlling the switch in the low side portion of the LED dimming driver 10. In addition, dither can be used to aid in reducing EMI considerations. By adjusting the setpoint level in the RF controller 32, the current supplied to a load may be varied.

The RF controller 32 may have a wired interface, a wireless interface, or a combination thereof. For example, the RF controller 32 may be adapted to receive a wireless RF control signal to set the dimming level and to turn on and off the load current, or may use an infrared control signal or other type of control signal, using any protocol now known or that may be developed in the future. The RF controller 32 may also include switches or other controls that may be set to control the load current in a desired state or to override other wireless or wired control signals. There also may be a wireless or wired set of signals used to control one or more additional units or power supplies from the same master control that receives (and can optionally transmit) information from one or more remote controllers.

The present invention can be controlled from multiple sources using multiple remote controller types. Such remote controller types can also be designed and configured to support other types of remote operation including remote control of entertainment such as televisions, radios, stereos, IPods, etc. and other types of appliances, garage door openers, thermostats, HVAC systems, water metering and valves, security systems, position sensing applications including garage door position sensors, other door sensors, temperature sensors, pressure sensors, carbon monoxide detectors, water/moisture sensors, etc. In addition, telephones including portable and cellular telephones including smart phones such as IPhones, Blackberry or Android or other smart phones, IPads and IPods, etc. can also be used as a remote control for the present invention. Also, sound detection such as clapping, speech, speech recognition, snapping fingers, etc. can also be used to remotely control the present invention. Remote controls for this present invention also include computer based, web based, web-hosted, Internet based, USB based, serial and parallel based, server based, etc. types. More than one type of remote control may be active at a given time. In addition, both smart (i.e., active) and passive sensors may be used with the present invention to enable, for example, motion sensing, daylight harvesting, RFID detection, active cell phone detection, etc. to interact with, control, modify, modify current operational conditions, state, etc. the present invention. The LED dimming driver 10 may be connected directly or indirectly to the Internet if desired to perform these and other types of functions.

The RF controller 32 may be implemented as a modular circuit with a variety of models having different behaviors, so that different RF controllers 32 may be connected to change the behavior of the LED dimming driver 10.

A channel circuit 36 may be provided to drive an LED 40 or other lamp or load, powered by the power supply 22 and controlled by the RF controller 32. Note that the division of circuitry across the block diagram of FIG. 1 may be adapted as desired. For example, the load current through the LED 40 may be controlled by a comparator and/or op-amp that compares the load current with the current setpoint 34. This comparator and/or op-amp may be located in the channel circuit 36 or in other components of the LED dimming driver 10 as desired. Another method of control is the use of operational amplifiers or comparators or other electronics where a reference current set point could be set using a digital to analog converter. Furthermore, the present invention could also be designed with a mode of operation that allowed the present invention to be responsive to a wall dimmer, for example a TRIAC dimmer, that is attached to the input of the present invention. Thus, the present invention can also be dimmed using a standard "wall" dimmer that uses phase angle cutting to provide dimming such as a triac-based or transistor-based dimmer. The present invention can also act as a universal input voltage constant current or constant voltage output device where the constant current or constant voltage output is a parameter that can be selected and set in a number of ways including by remote setting with, for example, a precision and/or resolution that is digitally selectable and set. Such a precision and/or resolution can be as small or large as practically desired varying over fine and coarse ranges. For example the precision could be 1/1000th or 1/10,000th of full scale or set to 1/255th, 1/100th or 1/10th of full scale. These are merely illustrative examples of the precision and resolution and not meant to be limiting in any way or form for this present invention.

Figure 2:
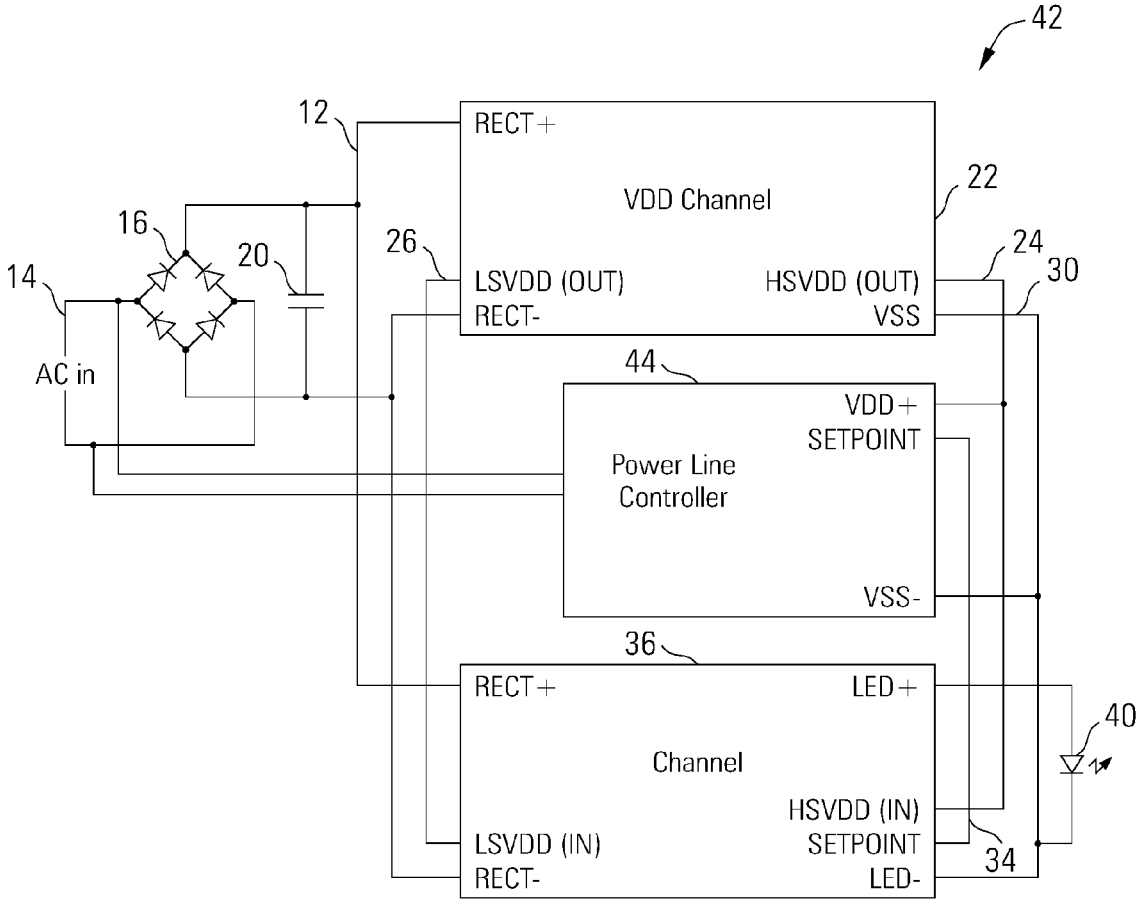
FIG. 2 depicts an example of a single channel LED dimming driver with a power line controller in accordance with some embodiments of the present invention.

As illustrated in FIG. 2, in another embodiment of an LED dimming driver 42 a power line controller 48 is used to receive external dimming commands and to generate the current setpoint signal 34 for the channel circuit 36. The power line controller 48 may be connected to the AC signal 14 to receive commands from an external control device via the AC lines using any power line command protocol currently known or that may be developed in the future. For example, command signals may be encoded in pulses that are superimposed on the AC waveform at the AC signal 14.

Figure 3:
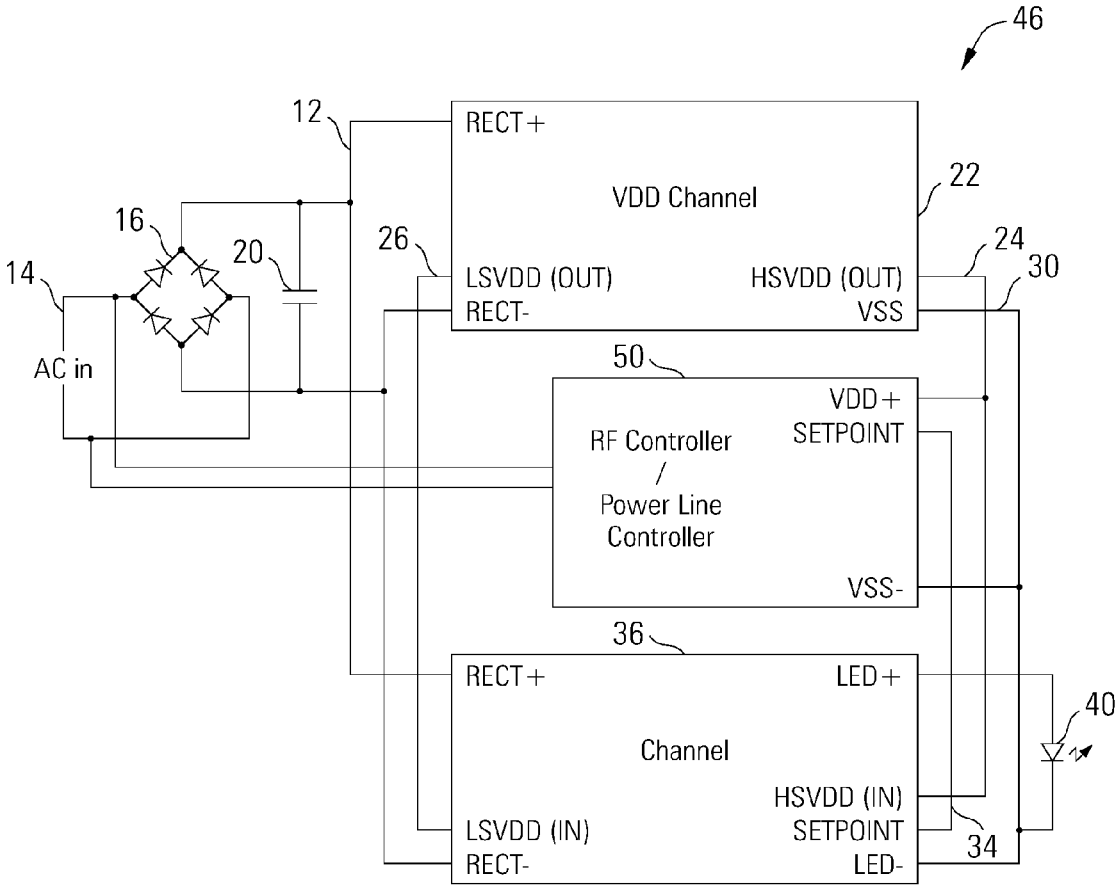
FIG. 3 depicts an example of a single channel LED dimming driver with a power line controller and an RF controller in accordance with some embodiments of the present invention.

As illustrated in FIG. 3, other embodiments of an LED dimming driver 46 may include a multi-interface controller such as an RF and power line controller 50, adapted to receive either or both RF command signals and power line command signals and to generate the current setpoint signal 34 based on either command signal. The RF and power line controller 50 may be adapted to give priority to one or the other, to balance the two signals, to give priority to the last command signal to change, to accept manual interface selection commands from one or the other command interface, or to use any other means for selecting one or the other or both of the command interfaces.

Figure 4:
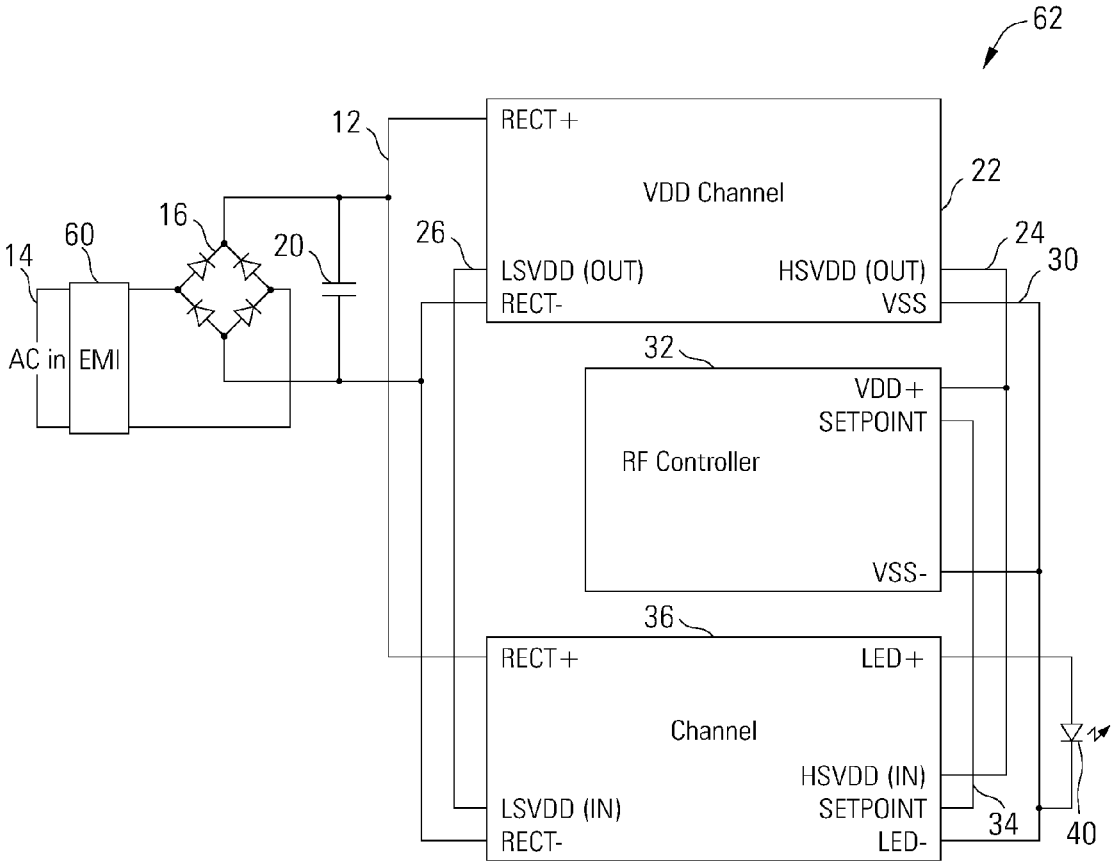
FIG. 4 depicts an example of a single channel LED dimming driver with an RF controller and an EMI filter in accordance with some embodiments of the present invention.
Figure 5:
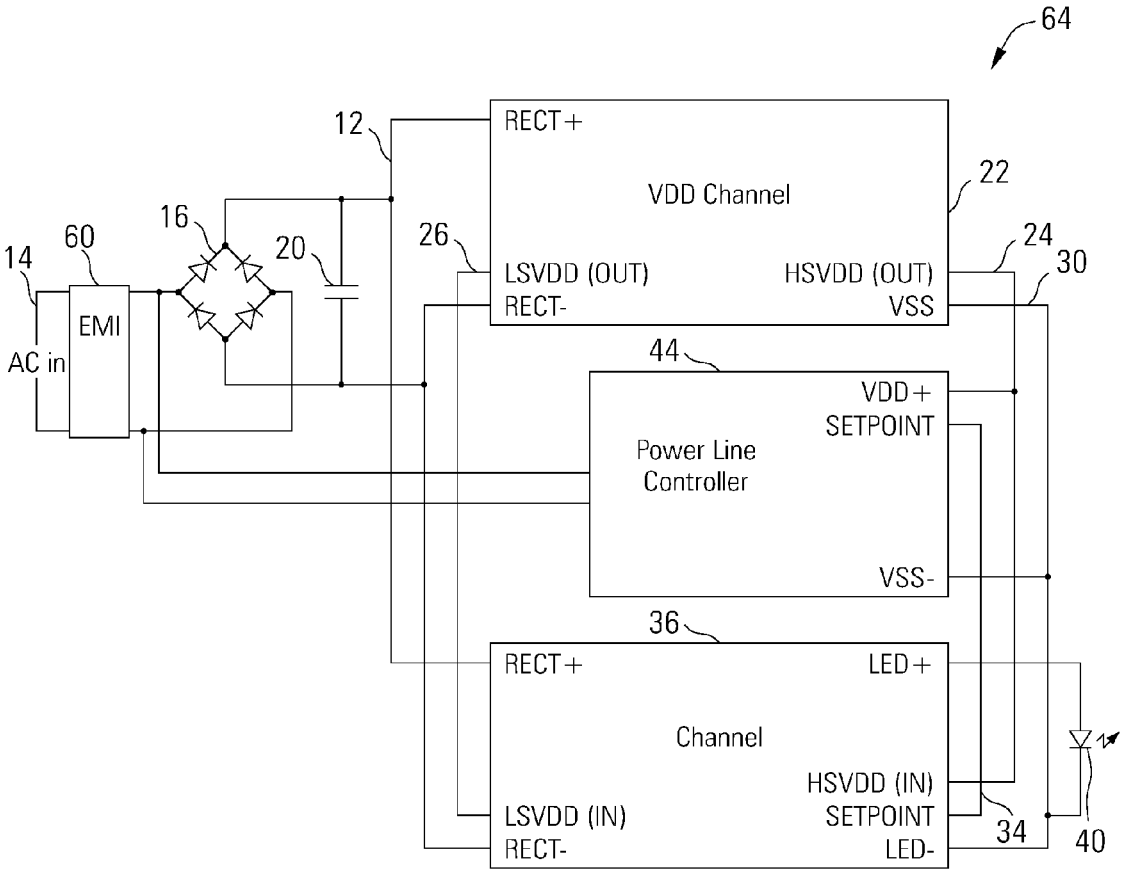
FIG. 5 depicts an example of a single channel LED dimming driver with a power line controller and an EMI filter in accordance with some embodiments of the present invention.
Figure 6:
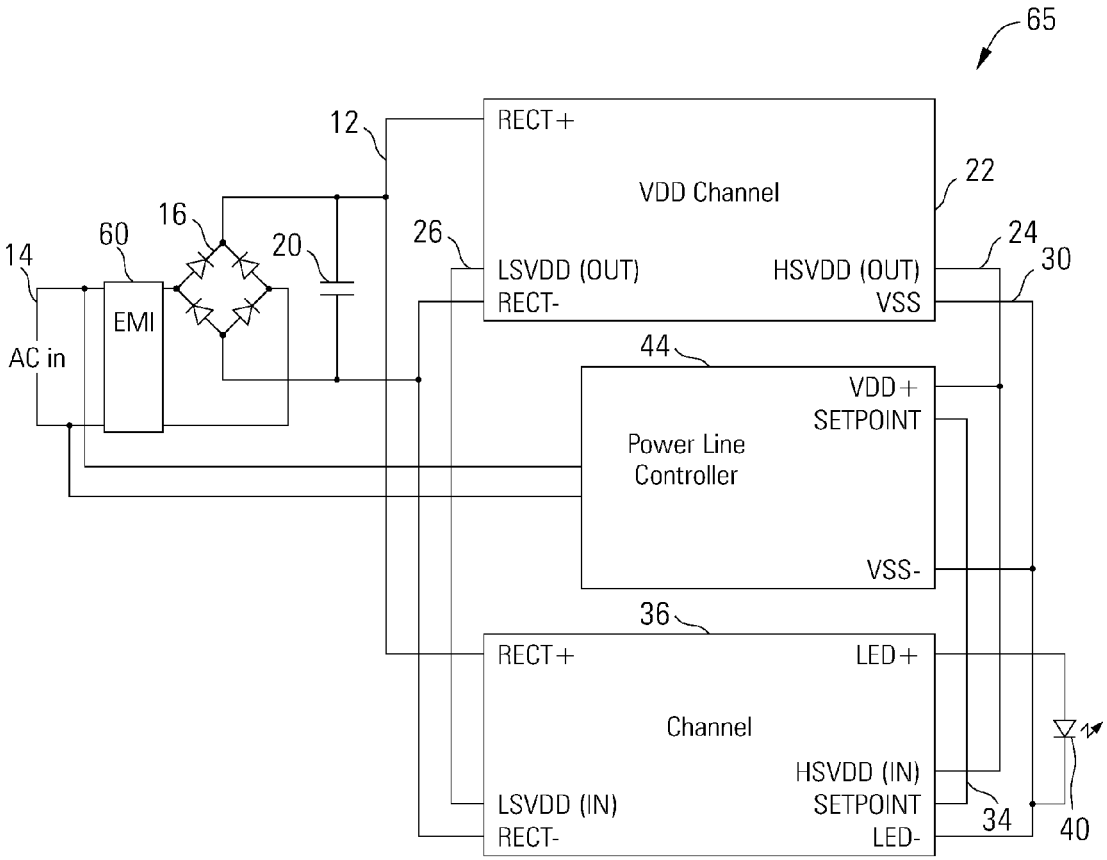
FIG. 6 depicts another example of a single channel LED dimming driver with a power line controller and an EMI filter in accordance with some embodiments of the present invention.
Figure 7:
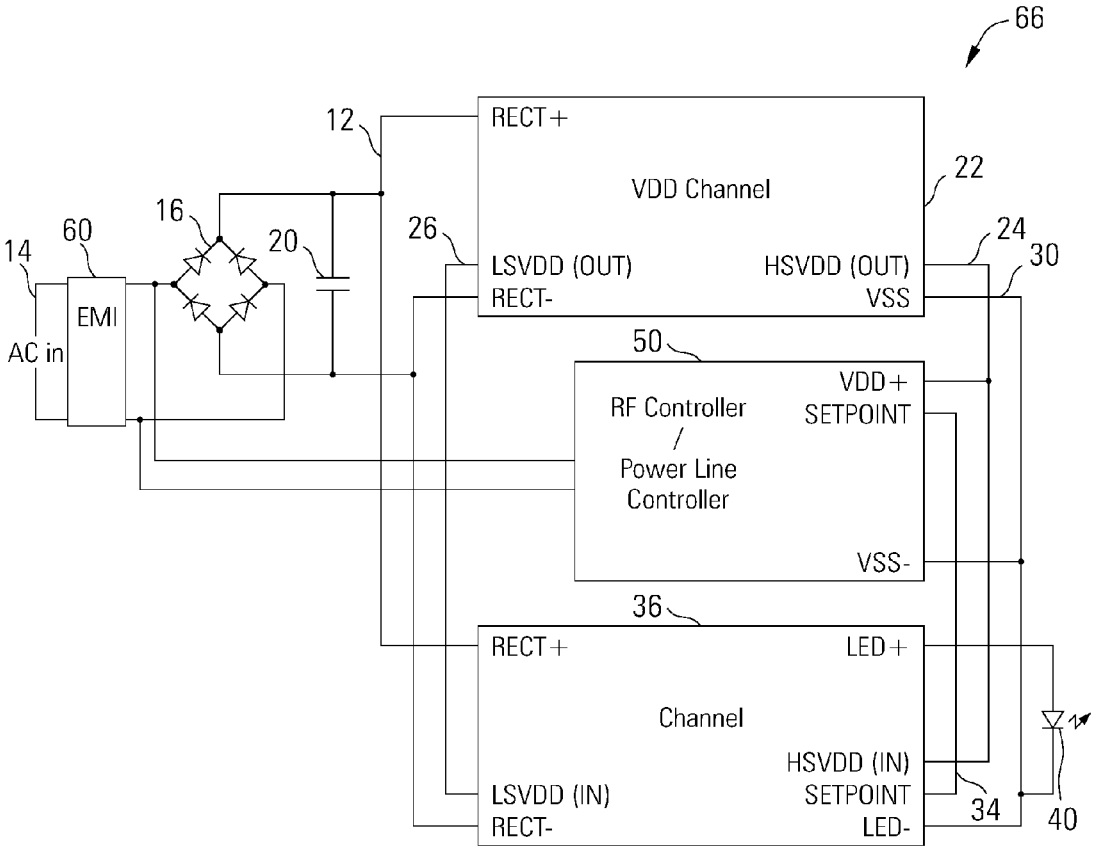
FIG. 7 depicts an example of a single channel LED dimming driver with a power line controller and RF controller and an EMI filter in accordance with some embodiments of the present invention.

An electromagnetic interference (EMI) filter 60 may be included in some embodiments of an LED dimming driver 62 as illustrated in FIG. 4, for example connected to the AC signal 14 before the diode bridge 16, or after the diode bridge or in other suitable locations as desired. One or more EMI filters (e.g., 60) may be included in any of the embodiments disclosed herein or in variations of these embodiments, such as the LED dimming driver 64 with power line controller 44 of FIG. 5 or the LED dimming driver 66 with RF and power line controller 50 of FIG. 7. All embodiments of the invention having power line controllers, including those illustrated and described in detail herein, and their variations, may be adapted to have power line connections connected to the AC signal 14 either before the EMI filter 60 as in the LED dimming driver 65 of FIG. 6 or after the EMI filter 60 as in other figures, with the controllers and EMI filter adapted as needed to pass information via power line through the EMI filter when connected after the EMI filter.

Figure 8:
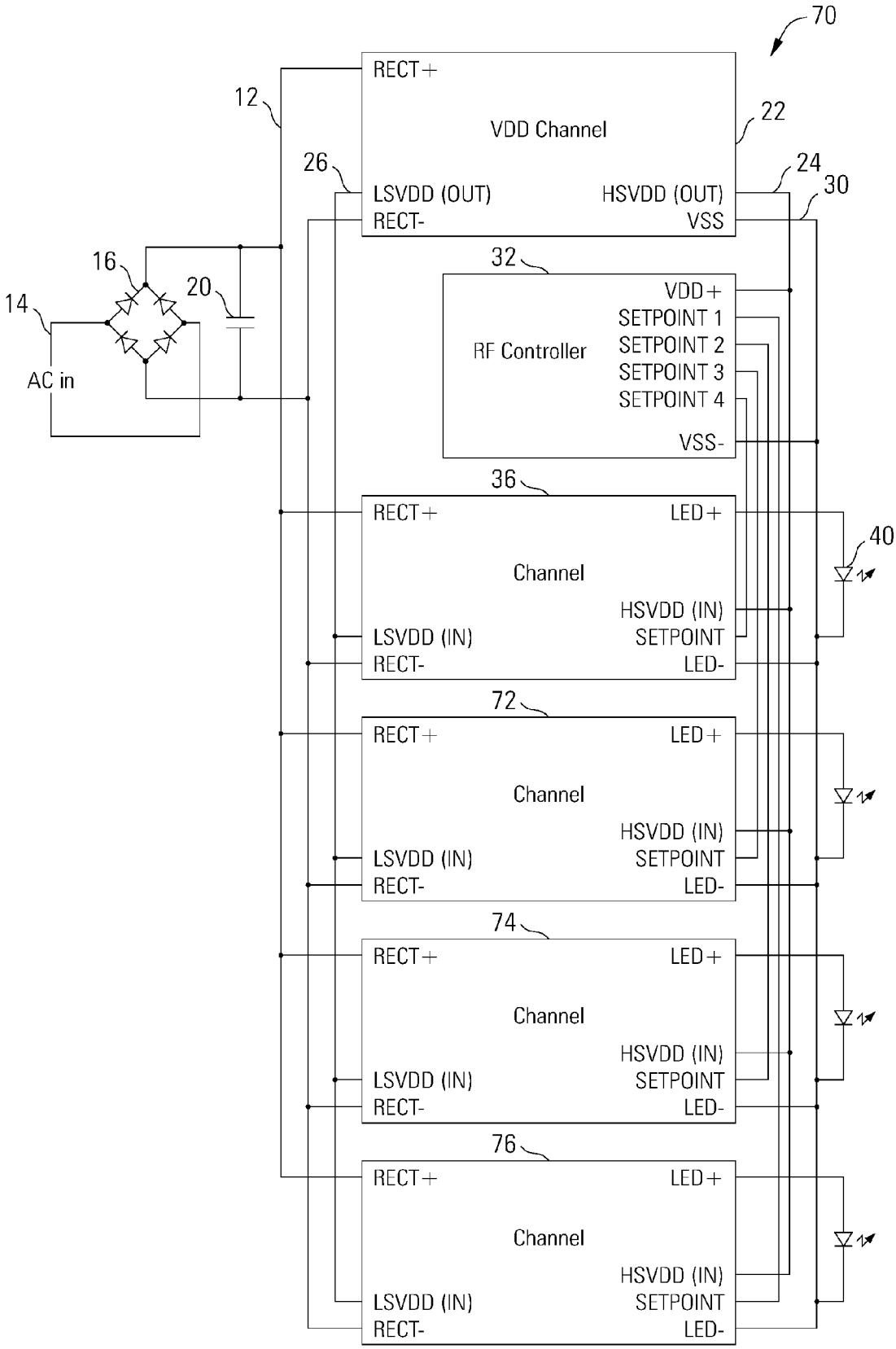
FIG. 8 depicts an example of a four channel LED dimming driver with an RF controller in accordance with some embodiments of the present invention.

The LED dimming driver 10 may be used to drive and dim one or more loads (e.g., 40) using a single channel circuit 36 as illustrated in FIGS. 1-6, or embodiments of an LED dimming driver 70 may include any number of channels 36, 72, 74 and 76 as illustrated in FIG. 8. Multiple channels 36, 72, 74 and 76 may be used for any suitable purpose, such as for different lighting areas which are independently controllable, or for a multi-color panel. For example, different channels may be provided to control red, green and blue LEDs in an RGB panel of LEDs, with the different channels enabling a user to select any desired color and illumination level. Multiple sets of separate drivers may also be controlled either wirelessly or wired in, for example, a master slave configuration. In any event, if using power line to control and monitor, information can be and is obtained via the power line(s) for the present invention.

Figure 9:
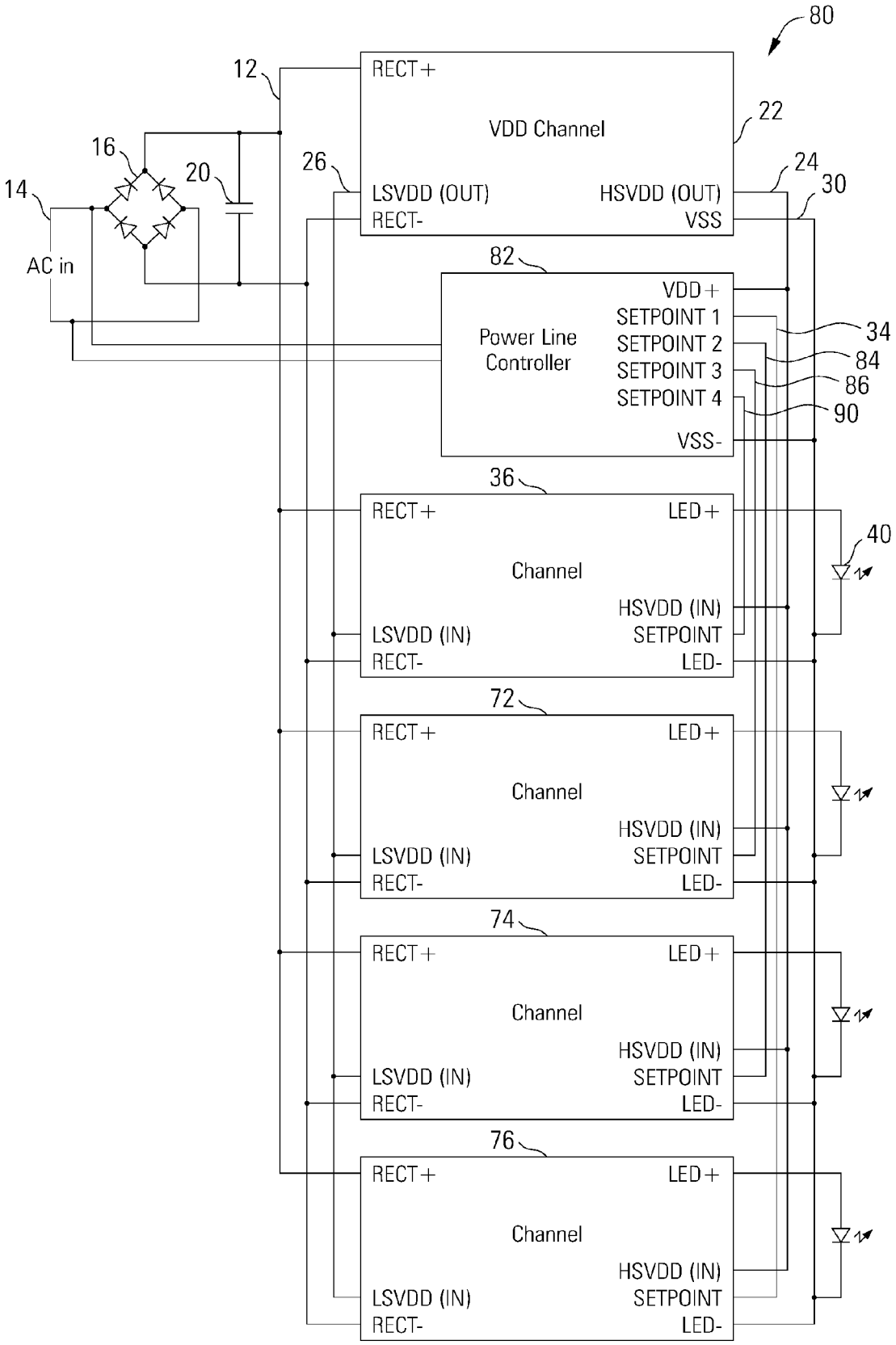
FIG. 9 depicts an example of a four channel LED dimming driver with a power line controller in accordance with some embodiments of the present invention.
Figure 10:
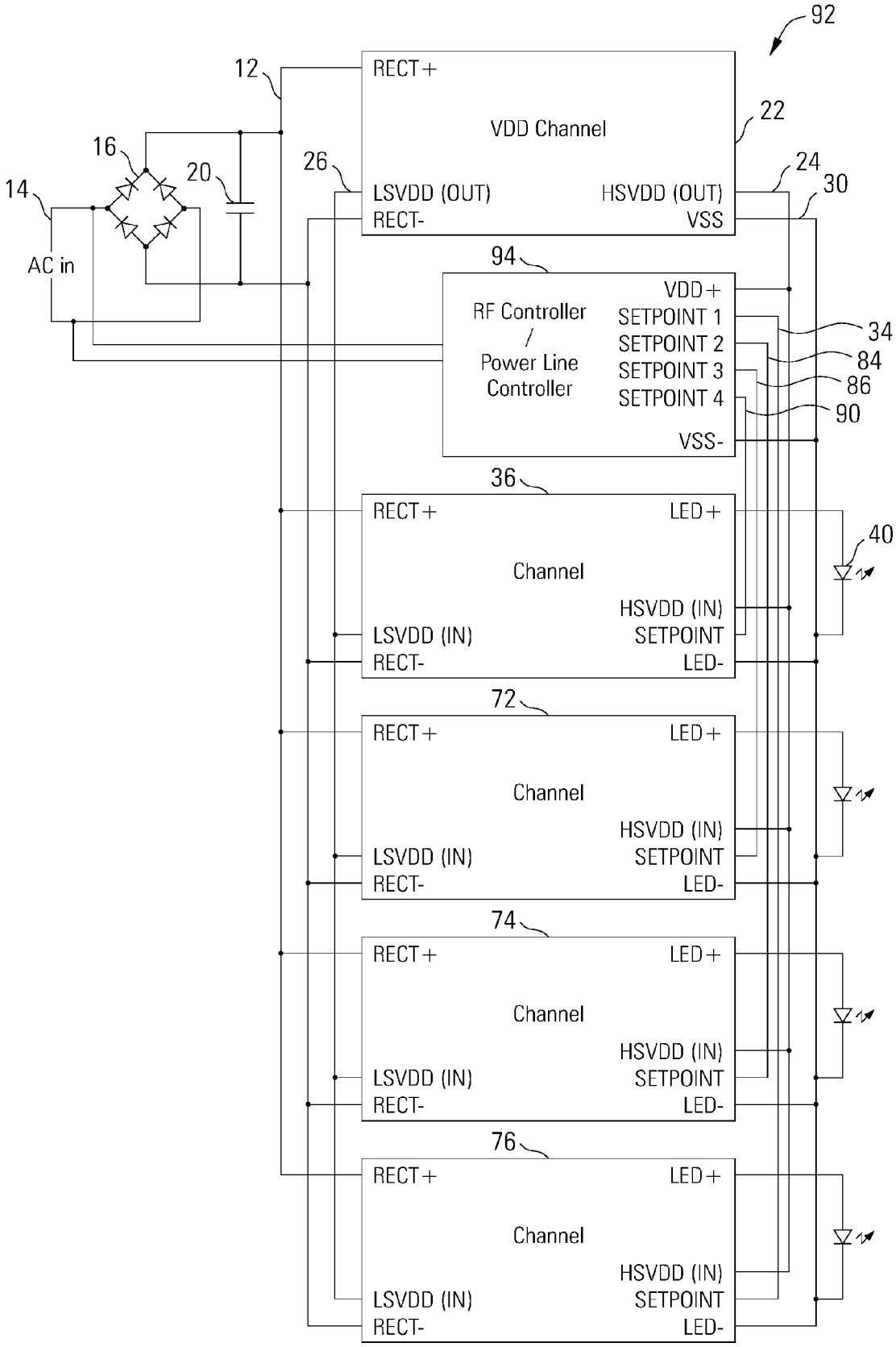
FIG. 10 depicts an example of a four channel LED dimming driver with a power line controller and an RF controller in accordance with some embodiments of the present invention.

Some multi-channel embodiments of an LED dimming driver 80 include a power line controller 82 with multiple output current setpoint signals 34, 84, 86 and 90 as illustrated in FIG. 9. Yet other multi-channel embodiments of an LED dimming driver 92 include an RF and power line controller 94 with multiple output current setpoint signals 34, 84, 86 and 90 as illustrated in FIG. 10.

Figure 11:
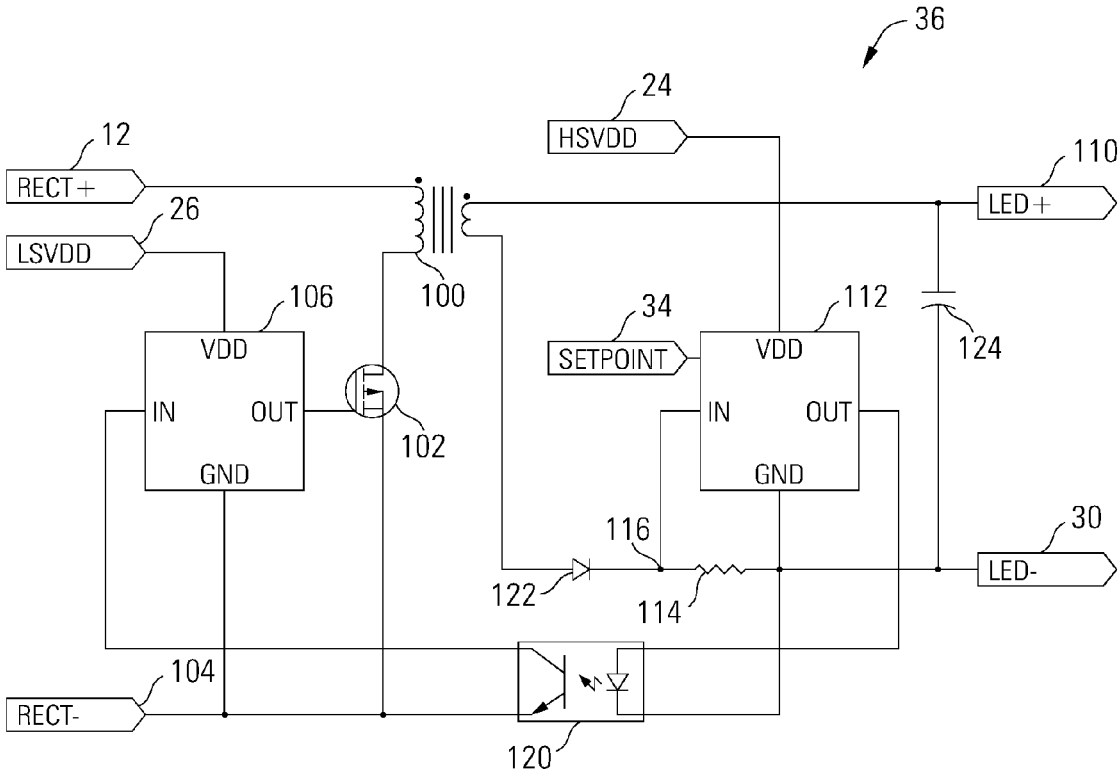
FIG. 11 depicts an example of a channel circuit as it may be used in an LED dimming driver.

An example of a channel circuit 36 that may be used in the LED dimming driver 10 is illustrated in FIG. 11, although the LED dimming driver 10 is not limited to this particular example. A transformer 100, inductor or other device may be used to isolate the high side (or secondary side) and low side (or primary side) of the channel circuit 36. A switch or transistor 102 controls the current flow through the primary side of the channel circuit 36 as supplied through the RECT+ 12 and RECT− 104 (see also FIG. 1) signals from the diode bridge 16. The transistor 102 may be controlled in any suitable manner, such as by a pulse width modulation (PWM) circuit 106 based on feedback from the secondary side of the channel circuit 36. The secondary side of the channel circuit 36 measures and controls the load signals LED+ 110 and LED− 30 (or VSS). A comparator and/or opamp 112 or similar or analogous device compares the load current (measured across a sense resistor 114 at node 116 referenced to ground) against the setpoint reference signal 34 from the RF controller 32. (The load current may be measured in any of a number of alternate ways and at different locations in the channel circuit 36 if desired.) The control signal from, for example, the op amp and/or the comparator 112 to the PWM circuit 106 may be isolated by an optocoupler, optoisolator 120 or other device, if so desired or needed, if the channel circuit 36 is designed such that the high side and low side may float at different potentials. When the load current exceeds the setpoint value 34, it is reduced to about the level of the setpoint 34, for example by reducing the pulse width and/or the on time controlling the switch 102 in the primary side of the channel circuit 36. When the load current falls below the setpoint 34, it is increased to about the level of the setpoint, for example, by increasing the pulse width and/or the on time controlling the switch 102. By adjusting the level of the setpoint 34 in the RF controller 32 or power line controller 44 or RF and power line controller 50, the current supplied to a load may be varied. A diode 122 may be included in series with the load path 110 and 30 to protect the load and other circuit components. An output capacitor 124 may also be included to filter the voltage and/or current applied to the load.

The present invention can be realized in numerous ways using a variety of topologies, approaches, and architectures including, but not limited to, one or more of the following: buck converters, boost converters, boost-buck converters, buck-boost converters, flyback converters, inductor based converters, isolated converters, non-isolated converters, CUK, SEPIC, PWM converters, continuous conduction mode, discontinuous conduction mode, critical conduction mode, resonant conduction mode, DC to DC converters, digital power supplies, etc. The present invention can use a number of these topologies and architectures in realizing and implementing the present invention. The present invention produces high power factor correction (PFC) at any load conditions including full power on (i.e., no dimming), half power on, partial power on, nearly turned off, etc. Various types of over protection including but not limited to over current protection (OCP), over voltage protection (OVP), short circuit protection (SCP), over temperature protection (OTP), etc. can be employed and used in the present invention. In addition various types of sensing can also be employed including light sensing in a variety of ways and forms including intensity, color temperature, color uniformity, etc. and temperature, humidity, etc.

Additional components and devices may be included in the LED dimming driver 10, such as analog to digital (A/D) converters to measure dimming levels, input voltage and/or current levels, output voltage and/or current levels, power factor, power usage, power costs, etc. to a user. For example, these conditions may be reported to and displayed on a wireless or wired dimming controller linked to the LED dimming driver 10 and may be stored on such a wireless or wired controller, a computer or computers, a network of computers, a server, a website or more than one website, a smart power meter, or on accounts associated with the user including related to electrical power usage, etc. Smart power grid components may also be included to monitor power usage, power factor, voltage and/or current levels, etc and report to a user and/or to other entities including power utility companies, etc.

The LED dimming driver 10 thus provides a system to drive LEDs or other types of lights or loads and to reliably dim them, with a much more flexible control interface than existing types of dimmers such as wall-mounted TRIAC-based dimmers with control knobs or sliders. However the LED dimming driver can have a mode in which it is responsive to such types of dimmers. Multiple channels may be provided to control different lighting areas and/or control the color as well as illumination level of the light. The LED dimming driver 10 may also be modular with swappable components to allow for cost-effective customization. As stated above, embodiments of the present invention may include, but are not limited to, transceivers to transmit information including power factor, input voltage, current, power, frequency, energy usage, etc. and information associated with the output including, but not limited to, LED current, LED voltage, PWM control information, switching pulse duration, pulse off time, light/lumen output, temperature, etc.

While illustrative embodiments have been described in detail herein, it is to be understood that the concepts disclosed herein may be otherwise variously embodied and employed and the example embodiments presented should not be viewed as limiting in any way or form.

What is claimed is:

1. An apparatus for dimmably driving at least one load, the apparatus comprising:

a power supply having a voltage output;

a controller having at least one current setpoint output; and at least one driver channel circuit connected to the voltage output of the power supply and to at least one of the at least one current setpoint outputs, the at least one driver channel circuit having a load output, wherein the at least one driver channel circuit comprises a plurality of driver channel circuits, and wherein the controller has a plurality of current setpoint outputs connected to the plurality of driver channel circuits.

2. The apparatus of claim 1, wherein the controller comprises an interface selected from a group consisting of a wireless interface, a power line interface, and a combination wireless and power line interface, wherein the interface is adapted to receive dimming control commands.

3. The apparatus of claim 1, wherein the controller is adapted to be responsive to an external dimmer.

4. The apparatus of claim 3, wherein the external dimmer comprises a triac-based dimmer, and wherein the controller is adapted to set the at least one current setpoint output based at least in part on a signal that is affected by the external dimmer.

5. The apparatus of claim 1, wherein the controller is adapted to set the at least one current setpoint output at a level proportional to an externally selected dimming level.

6. The apparatus of claim 1, wherein the controller comprises a swappable module.

7. The apparatus of claim 1, wherein the controller is adapted to independently control each of the plurality of driver channel circuits.

8. The apparatus of claim 7, wherein the plurality of driver channel circuits comprise a white channel, a red channel, a green channel and a blue channel.

9. The apparatus of claim 1, further comprising a rectifier connected between an AC input and the power supply.

10. The apparatus of claim 1, further comprising an electromagnetic interference filter connected to the power supply.

11. An apparatus for dimmably driving at least one load, the apparatus comprising:

a power supply having a voltage output;

a controller having at least one current setpoint output; and at least one driver channel circuit connected to the voltage output of the power supply and to at least one of the at least one current setpoint outputs, the at least one driver channel circuit having a load output, wherein the driver channel circuit comprises a primary side circuit and a secondary side circuit, and wherein the voltage output of the power supply comprises a plurality of voltage outputs, wherein the primary side circuit and the secondary side circuit are powered by different ones of the plurality of voltage outputs of the power supply.

12. The apparatus of claim 11, wherein current flow through the primary side circuit is controlled by a switch.

13. The apparatus of claim 12, wherein the secondary side circuit comprises a comparator adapted to compare a load current with the current setpoint output, and wherein the switch is controlled by an output of the comparator.

14. The apparatus of claim 13, further comprising an isolation device and a pulse width modulation circuit connected between the comparator and the switch.

15. The apparatus of claim 11, wherein the at least one driver channel circuit comprises a plurality of driver channel circuits comprising a white channel, a red channel, a green channel and a blue channel.

16. The apparatus of claim 11, wherein the controller comprises a wireless interface, and wherein the interface is adapted to receive dimming control commands.

17. The apparatus of claim 11, wherein the controller comprises a power line interface, and wherein the interface is adapted to receive dimming control commands.

18. A method for dimmably driving a load, the method comprising:

generating a first voltage and a second voltage in a power supply from a power input, wherein the first voltage is higher than the second voltage;

receiving dimming commands and generating at least one current setpoint signal in a controller circuit; and driving a load output in at least one driver channel circuit based at least on the first voltage, the second voltage and the at least one current setpoint signal, wherein driving the load output in at least one driver channel circuit comprises independently driving a plurality of load outputs in a plurality of driver channel circuits.

19. The method of claim 18, wherein receiving dimming commands comprises receiving wireless signals.

20. The method of claim 18, wherein receiving dimming commands comprises receiving signals via power line.

* * * * *